United States Patent [19]

Tange

[11] 4,240,575

[45] Dec. 23, 1980

[54] EGG CARTON WITH CRUSH RESISTANT TOP

[75] Inventor: Charles H. Tange, Victor, N.Y.

[73] Assignee: Mobil Oil Corporation, New York, N.Y.

[21] Appl. No.: 36,947

[22] Filed: May 7, 1979

[51] Int. Cl.[3] ..... B65D 1/24; B65D 1/36

[52] U.S. Cl. ..... 229/29 M; 229/4.5 EC; 229/2.5 EC

[58] Field of Search ..... 229/2.5 R, 28, 29 M; 264/53, 4.5 EC

[56] References Cited

U.S. PATENT DOCUMENTS

| | | | |
|---|---|---|---|
| 2,517,465 | 8/1950 | Cox | 229/28 R X |
| 3,138,314 | 6/1964 | Reifers et al. | 229/29 M X |
| 3,144,973 | 8/1964 | Heintzelman | 229/29 M UX |
| 3,207,409 | 9/1965 | Reifers et al. | 229/29 M X |
| 3,388,852 | 6/1968 | Reifers | 229/29 M X |
| 3,444,283 | 5/1969 | Carlson | 264/53 |
| 3,643,855 | 2/1972 | Donaldson | 229/2.5 X |

FOREIGN PATENT DOCUMENTS

| | | | |
|---|---|---|---|
| 1200661 | 7/1970 | United Kingdom | 229/29 M |

*Primary Examiner*—Davis T. Moorhead

*Attorney, Agent, or Firm*—Charles A. Huggett; James D. Tierney

[57] ABSTRACT

A disposable carton formed of low cost material and adapted for the packaging of eggs and the like is formed with coacting elements of a cover and latching flap which, in combination, afford rigidity to those elements, guide the coacting elements on closure and provide for a secure latching susceptible of easy opening. Recesses are provided in cover and latching flap for guidance and rigidity. Latching is accomplished by a recess extending inwardly from the cover front wall to engage the underside of a latching bar of the flap, which is positioned above a substantially rectangular shaped recess in the latching flap. The carton is particularly characterized in that it exhibits improved resistance to crushing when other cartons are stacked upon it. This crush resistance is imparted to the carton by employing integrally molded cover support ribs which are positioned immediately above and adjacent to the locking recesses on the latching flap. Such an arrangement allows the upper edge of the locking aperture on the carton front wall to bear against the cover support ribs for additional support and to withstand crushing forces which may be applied to the carton cover.

1 Claim, 2 Drawing Figures

EGG CARTON WITH CRUSH RESISTANT TOP

BACKGROUND OF THE INVENTION

1. Field of the Invention

The present invention is concerned with disposable cartons for packaging such merchandise as eggs and characteristically comprises a bottom tray portion formed to provide cells for the packaged goods, a top cover portion hinged to the rear of the tray and a latching flap hinged to the front of the tray. The latching flap is adapted to coact with the cover for retention of the closure. More particularly the invention concerns a novel structure on the latching flap which provides a positive restraint for the cover so that when crushing forces are applied, generally perpendicular to the plane of the cover, cover support ribs are so positioned on the flap to prevent the cover member from coming into crushing contact with the carton contents.

2. Description of the Prior Art

Egg cartons of this general type have been common for many years. An early type is shown by Cox U.S. Pat. No. 2,517,465 in which the latching flap is exterior of the cover and provided with tabs insertable into slots in the front face of the cover. Cartons of the same general nature but having an inner latching element are shown by Schilling U.S. Pat. No. 2,600,130 in which the latching flap is extended to provide upper cells intended to afford greater protection to the packaged eggs. Schilling provides a friction type latch in which a protrusion in front of the flap engages a matching recess in the cover.

Many attempts have been made to improve on the Schilling carton by different specific configuration of latching mechanisms. Most of the subsequent development has eliminated the extension of the latching flap as an unnecessary precautionary structure, it being found that eggs supported in properly designed cells of the tray suffer little breakage during transit under any reasonable handling without the positive cell structure in an upper part of the carton.

For the most part, egg cartons are today filled and closed on automatic machinery which imposes certain restrictions on acceptable structures. A further restraint on acceptable structures is imposed by the characteristics of the material from which the carton is formed. Most such cartons are prepared on molding machinery from either wood pulp or thermoplastic material and the structure must be such that it can be formed from these inexpensive materials at high speed and readily stripped from the molds. Each of the two types of material (pulp and thermoplastic) and the types of equipment on which these may be formed has its own idiosyncrasies to which the carton structure must accommodate.

Much of the effort toward design of molded egg cartons has been concerned with adaption to molding machines, materials and techniques and to the demands of automatic filling and closing machinery. U.S. Pat. No. 3,648,916 discloses egg carton structures together with their associated locking mechanism which are similar in construction to the egg carton structures of the present invention. The carton structures in this patent resist crushing compressive forces by virtue of a recess molded in the central portion of the carton cover which presses against a cross rib member in the cellular bottom section when compression is applied to the carton cover section.

Absent such a recess in the central portion of the cover which provides a protrusion to bear against one of the cross ribs cellular sections, there is a pronounced tendency when compressive forces are applied to the cover, for the front wall of the cover to roll down below its intended position whereby the upper edge of the aperture, forming the cover latching portion, slides over and down the upper portion of the latching flap element. Obviously when forces are exerted against the cover in a direction generally perpendicular to the plane of the cover and this rolling action occurs it will cause damage to the fragile contents of such cartons, i.e. eggs and the like.

SUMMARY OF THE INVENTION

The present invention involves a combination of structural coacting elements employed to releasably latch together egg carton sections and to improve the resistance of such egg cartons to crushing forces applied to the cover of such cartons when they are in stacked arrangements, for example. The coacting elements include elements positioned in the front wall of the cover and in the latching flap which are capable of rapid and efficient formation on automatic molding machinery and affording significant advantages in filling, closing, shipping, marketing, household storage and resistance to crushing or collapsing forces which may be applied in the shipment or storage of such cartons. The front of the cover and the latching flap are provided with complementary recesses extending inwardly from the front of the carton and each defined by relatively flat recess surfaces connected to the front primary plane of each element (cover and flap) by webs essentially planar in nature and sloping sharply toward the recessed surface. Additionally, protruding cover support ribs positioned on the upper portion of the latching flap offer increased resistance to crushing forces for such cartons.

BRIEF DESCRIPTION OF THE DRAWINGS

Specific embodiments of the invention are shown in the annexed drawings wherein.

DESCRIPTION OF SPECIFIC EMBODIMENTS

Figure 1:
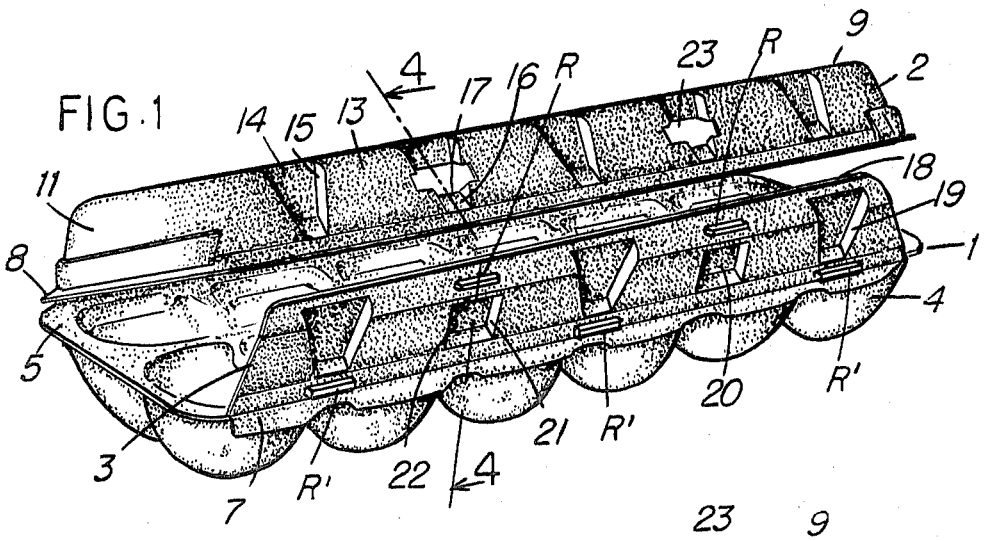
FIGS. 1, 2 and 3 are perspective views of one form of the carton in varying stages of closure.
Figure 2:
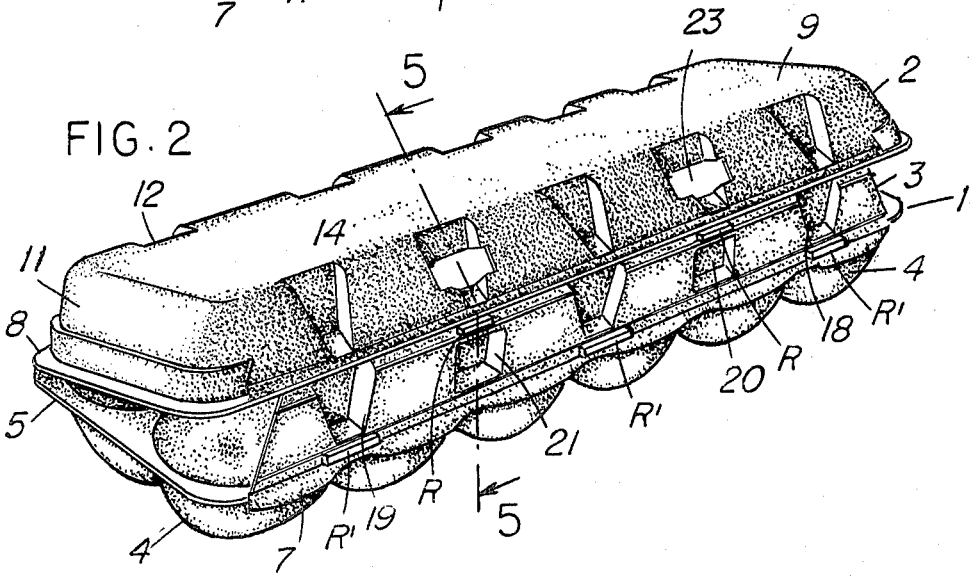

As shown in the drawings, the carton is constituted by a bottom tray portion 1, a cover 2, and a latching flap 3. The tray portion is formed to provide a plurality of cells 4 for reception of eggs and the like molded integrally with dividing surfaces and an upper flange 5 which may lie wholly in one plane. The cover 2 is formed integrally with the tray 1 and connected thereto by a portion of reduced thickness 6 constituting a hinge.

Similarly, the latching flap 3 is formed integrally with the tray 1 and connected thereto by a line of reduced thickness 7 constituting a resilient hinge.

As formed in a mold, the three portions of the carton are in their greatest extended position such that the flange 8 of the cover lies in the same plane as flange 5 of the tray and the latching flap 3 lies extended out to the other side of the carton as formed. This imparts to the hinges 6 and 7 a bias toward extended position.

With particular reference to the cover 2, this is constituted by an upper surface 9 which, in the embodiment shown, is essentially planar. Molded integrally with the top surface 9 are side walls 11, a back wall 12 and a front wall 13. Formed in the front wall are recesses constituted by depressed surfaces 14 and webs 15 of a structure such as to impart to the front wall a high degree of strength and rigidity capable of supporting burdens of cartons stacked one above another and of maintaining alignment of the front surface for efficient action of the latching mechanism also characteristic of this invention. In order to insure that the relatively severe crushing forces, which are encountered when individual loaded cartons are stacked one upon the other, cover support ribs are provided in each of the lock elements to provide additional support and prevent rollover of the carton front wall to a position below which it was originally intended to assume in a closed position. The latch elements of the cover are contituted by detents 16 formed of recessed surfaces and webs similar to those of the guiding elements, but terminating in a free edge 17.

Formed in the latching flap are recesses constituted by recessed surfaces 18 and webs 19 complementary to the recesses in the cover. It will be noted that the cover recesses and the flap recesses are wedge shaped and complementary in form. This structure assures that these guidance elements shall become engaged after cover is rotated into closed position and that as the flanges 5 and 8 approach contact, the complementary recesses fit snugly together and assure positive latch engagement.

Figure 4:
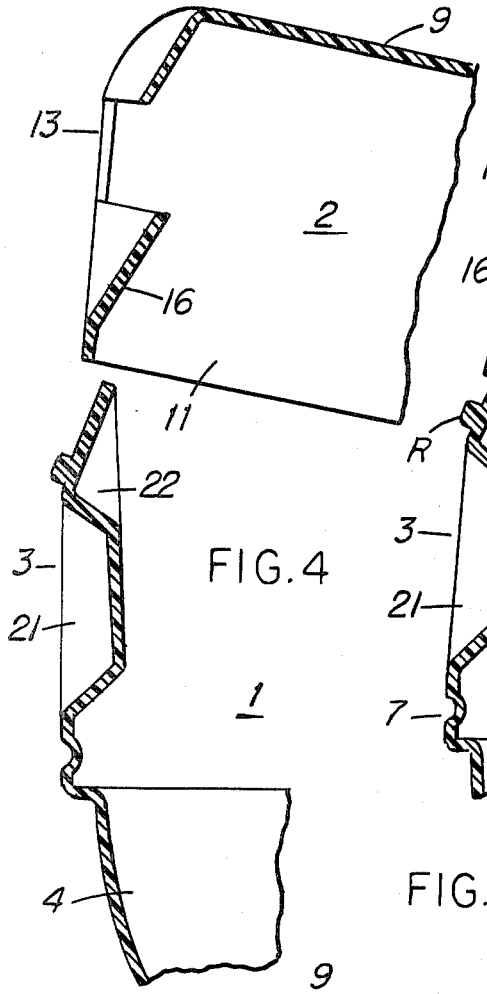
FIGS. 4, 5 and 6 are sections along the line 4—4, 5—5 and 6—6 of FIGS. 1, 2 and 3 respectively, illustrating how the latch element engages upon closure and how the cover support ribs operate.
Figure 5:
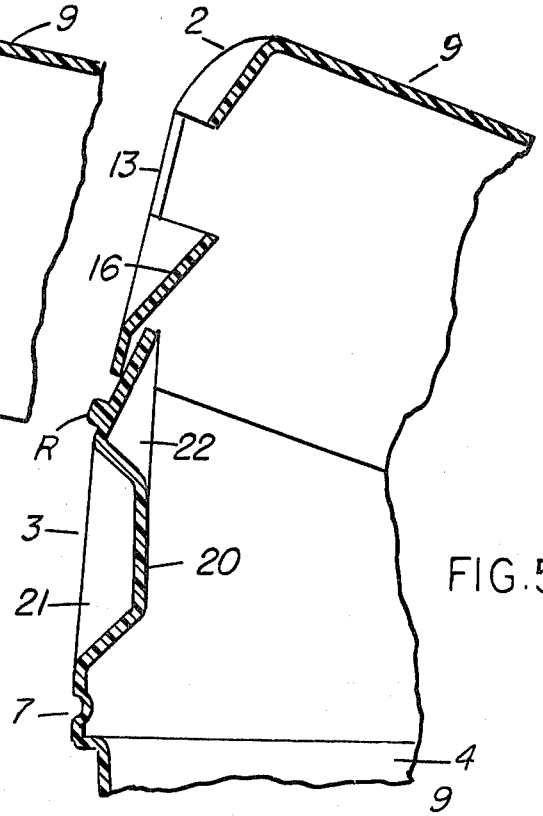

The latching element of the latching flap is constituted by a recess similar, but shorter in extent, than those which impart strength and guidance. A recessed surface 20 is connected to the main body of the flap of webs 21. The essentially wedge shaped recess terminates short of the upper egde of the flap to provide a latching bar 22 above the recess. Upon rotation of the cover to close position, the detent 16 enters into the recess bounded by webs 21 and detent edge 17 engages the latching bar 22. This manner of closure is more fully illustrated in FIGS. 4, 5 and 6 showing how the rigid face of the cover presses the latching flap rearward against its resilient hinge until the latch elements are engaged, as in FIG. 6.

The embodiment shown in FIGS. 1 through 6 is characterized by a recess in the latching elements of the cover fully extending to the upper surface of the cover. These are readily formed by molding elements similar to those which form the guidance recesses. The detent is readily formed by cutting from such a recess a rectangular portion of the structure indicated generally at 23. This embodiment of the invention is readily formed on automatic thermoforming machinery followed by a cutting operation.

Figure 3:
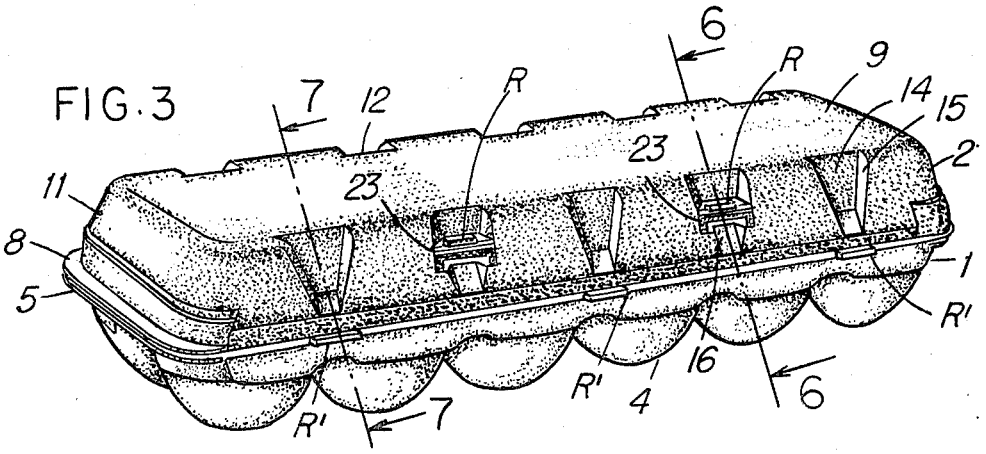
Figure 6:
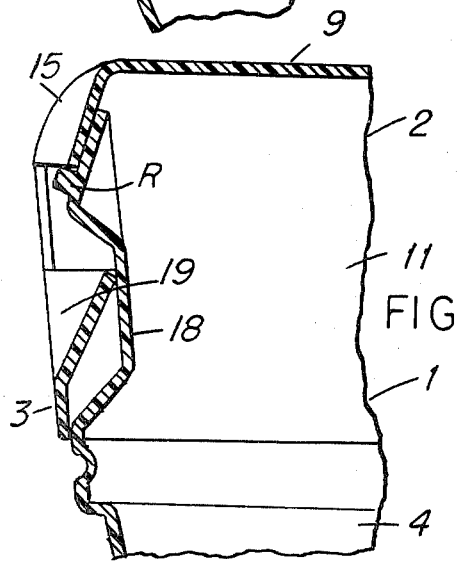

As shown in the drawings, cover support rib R, which is integrally molded with the carton latching flap, is positioned immediately above latching bar 22 so that when the carton assumes a closed position, as shown in FIGS. 3 and 6, the upper edge of aperture 23 is positioned adjacent to and in contact with cover support bar R whereby resistance to further downward movement of the carton lid when compressive forces are applied thereto is effectively resisted.

Among some of the types of plastic materials which are suitable for fabrication into the carton structures of the present invention are polyolefins such as polyethylene, polypropylene, and polybutene; polystyrene; high impact polystyrene; polyurethane; polyvinylchloride and others. A particular material which has been found to be well suited for fabrication of the present carton structures is foamed polystyrene. The closed cell structure of the foamed polystyrene is a material which rapidly reaches equilibrium with atmospheric moisture and therefore exerts no drying effect. The foam material itself is extremely light weight permitting ease of handling and transport. It will also be understood that molded pulp and the like may also be used to form the cartons of the present invention.

As hereinbefore indicated, a preferred material employed in the formation of the carton structures of the present invention is plastic and in particular foam thermoplastic materials and especially polystyrene foam. The polystyrene foam may be manufactured utilizing any one of the number of conventional extrusion techniques, for example, extrusion of foamable polystyrene beads, ie., beads which have a blowing agent already incorporated in them prior to delivery to an extrusion apparatus or, for example, by direct injection extrusion techniques wherein a foaming agent is added to a molten mass of polystyrene contained within an extruder prior to extrusion thereof from a die orifice. See U.S. Pat. No. 3,444,283, Carlson.

After the polystyrene foam sheet material has been produced utilizing conventional extrusion techniques as discussed above, it may be molded to form the carton structures of the present invention. In general, it is desirable to preheat the formed polystyrene sheet before it is molded in order to assure that the sheet will be at a sufficiently elevated temperature to permit rapid forming of the desired structure in the mold.

After preheating the formed polystyrene foam sheet, the cartons of the present invention may be conveniently formed utilizing a molding operation such as match molding, for example.

The process employed for forming the cartons may best be understood by a description of a specific embodiment as illustrated in the following example, however, such a description is solely for purposes of illustration and is not to be construed in a limiting sense. For example, the following embodiment sets forth rather specific process and operating conditions employed when preformed polystyrene foam is employed as the starting material for the structure and, of course, such conditions will normally vary when other plastic materials are employed.

EXAMPLE 1

A preformed sheet of polystyrene foam material with an average density of about 7 pounds per cubic ft. and approximately 110 mils thick was fed into a radiant preheat oven and heated to a temperature of approximately 225° F. Upon emerging from the preheat oven, the polystyrene sheet was approximately 200 mils thick as a result of the expanding action of the residual blowing agent, in this case pentane, which remains entrapped within the polystyrene cells after it is extruded. The residence time of the polystyrene in the oven was approximately 5 to 20 seconds and the average line speed was about 15 ft. per minute. Immediately upon emergence from the preheat oven, the polystyrene foam sheet passes into a forming mold. The thermoforming mold employed is essentially a temperature controlled female mold maintained at about 150°0 F. and a lower male forming member maintained at a temperature of about 100° F. As the match mold is cycled, the upper and lower mold members are brought together forcing the heated polystyrene foam to assume the configuration of the mold members.

The shape of the molds and of the freshly molded carton is essentially that shown in FIG. 1 except that rectangular opening 23 has not been cut. As formed, the cover and flap in extended position as would appear on rotation of elements in FIG. 1 is as follows: the cover is rotated to the left to a position in which flange 8 lies in the same plane as flange 5 and the flap is rotated to the right until it also lies in that same plane.

Rectangular opening 23 is formed by a second operation in which the carton cover 2 is supported against a surface having a suitable die orifice and the openings 23 are cut out by punches.

Figure 7:
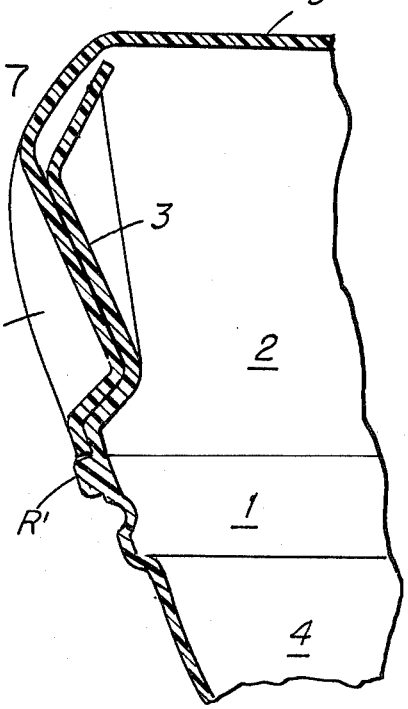
FIG. 7 is a cross-section taken along the line 7—7 of FIG. 3.

In an alternative form of the structure of the present invention, additional ribs R′ may be employed to offer additional support to the carton cover. As shown in FIG. 1, additional ribs R′ are preferably positioned immediately above and adjacent to flap hinge 7 and below the lowermost limits of recessed flap surfaces 18. As particularly shown in cross-section in FIG. 7 of the accompanying drawings, the lower edge of carton cover front wall 13, when the carton is in a closed position, bears against the additional support ribs R′, which offers increased resistance to carton collapse when forces are applied to the planar top portion of the cover in a generally perpendicular direction to the cover.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. In a carton adapted for the packaging of eggs and the like having (1) a bottom tray formed to define a plurality of cells for reception of packaged articles and of a depth such that said articles are enclosed thereby for a portion less than their vertical dimension as packaged, (2) a dished or cover resiliently hinged to the rear upper edge of said tray and having a front wall, a back wall, and end walls fixed to each other and to a top for said cover, all of such dimensions that the packaged articles are substantially enclosed within the edges of said tray, said front wall lying primarily in a plane sloping inwardly toward said top, and (3) a latching flap hinged to the front upper edge of said tray by resilient means biasing said flap toward a position outward of vertical from said front edge; said cover and said flap having coacting means associated therewith capable of engagement upon closure of the carton in a manner to maintain such closure;

the improvement which comprises cover support ribs integrally molded on said latching flap whereby when said carton is in a closed position said ribs are in restraining contact with said carton cover front wall; said support ribs being further characterized in that they are positioned at spaced apart locations along said latching flap hinge, and along the upper edge of said latching flap adjacent said coacting means on said latching flap, whereby said support ribs support said cover and resist compressive forces applied to said carton cover and tray.

* * * * *